US010558147B2

(12) United States Patent
Lidai et al.

(10) Patent No.: US 10,558,147 B2
(45) Date of Patent: Feb. 11, 2020

(54) ELECTROSTATIC PRINTING

(71) Applicant: HP INDIGO B.V., Amstelveen (NL)

(72) Inventors: Uri Lidai, Ness Ziona (IL); Shmuel Borenstain, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/199,586

(22) Filed: Nov. 26, 2018

(65) Prior Publication Data

US 2019/0094760 A1 Mar. 28, 2019

Related U.S. Application Data

(63) Continuation of application No. 15/545,932, filed as application No. PCT/EP2015/057109 on Mar. 31, 2015, now Pat. No. 10,156,816.

(51) Int. Cl.

| | |
|---|---|
| ***G03G 15/06*** | (2006.01) |
| ***G03G 15/10*** | (2006.01) |
| ***G03G 15/16*** | (2006.01) |
| ***G03G 15/01*** | (2006.01) |
| ***G03G 9/08*** | (2006.01) |
| ***G03G 9/12*** | (2006.01) |

(52) U.S. Cl.

CPC ..... *G03G 15/104* (2013.01); *G03G 9/0823* (2013.01); *G03G 9/12* (2013.01); *G03G 15/0168* (2013.01); *G03G 15/10* (2013.01); *G03G 15/1605* (2013.01)

(58) Field of Classification Search

CPC .... G03G 9/0823; G03G 3/12; G03G 15/0168; G03G 15/104; G03G 15/10; G03G 15/1605

USPC ..... 399/53–57, 222, 237, 240

See application file for complete search history.

(56) References Cited

U.S. PATENT DOCUMENTS

| | | | | |
|---|---|---|---|---|
| 5,317,373 | A | 5/1994 | Bares | |
| 5,519,476 | A | 5/1996 | Dalal | |
| 6,256,051 | B1 | 7/2001 | Asada et al. | |
| 6,603,934 | B2 | 8/2003 | Shimmura | |
| 8,050,613 | B2 * | 11/2011 | Domoto | G03G 15/6588 347/155 |
| 8,380,112 | B2 | 2/2013 | Imamura | |

(Continued)

FOREIGN PATENT DOCUMENTS

| | | |
|---|---|---|
| CN | 203876367 | 10/2014 |

OTHER PUBLICATIONS

Tagansky; "HP-Indigo Technology and its Application to Photo Printing"; International Symposium on Technologies for Digital Photo Fulfillment; Dec. 21, 2011; http://www.imaging.org/ist/publications/reporter/articles/REP27_1_TDPF2012_TAGANSKY_PG31.pdf.

*Primary Examiner* — Hoan H Tran

(74) *Attorney, Agent, or Firm* — HP Inc. Patent Department

(57) ABSTRACT

A method of electrostatic printing may include forming a latent electrostatic image on a surface and transferring a first volume of a charged toner to the latent electrostatic image on the surface. The method may also include transferring a second volume of a charged toner to the surface, such that a toner image including the first volume of charged toner and the second volume of charged toner is formed on the surface, the second volume of charged toner being disposed on the first volume of charged toner. The method may also include transferring the image to a print substrate.

20 Claims, 5 Drawing Sheets

(56) References Cited

U.S. PATENT DOCUMENTS

| | | | | |
|---|---|---|---|---|
| 8,805,220 | B2 * | 8/2014 | Bucks | G03G 15/0168 399/285 |
| 2007/0188535 | A1 | 8/2007 | Elwakil et al. | |
| 2009/0000508 | A1 | 1/2009 | Edison et al. | |
| 2014/0196623 | A1 | 7/2014 | Lopez et al. | |
| 2014/0331876 | A1 | 11/2014 | Shaul et al. | |

* cited by examiner

ELECTROSTATIC PRINTING

BACKGROUND

Electrophotographic printing processes may involve creating a latent electrostatic image on a photoconductive surface, the image and background areas having different potentials, applying a charged toner to the photoconductive surface such that the charged toner selectively binds to the latent electrostatic image while the background areas remain clean, and then transferring the charged toner in the form of the image to a print substrate.

BRIEF DESCRIPTION OF FIGURES

For a more complete understanding, reference is now made to the following description taken in conjunction with the accompanying drawings in which.

DETAILED DESCRIPTION

Figure 1:
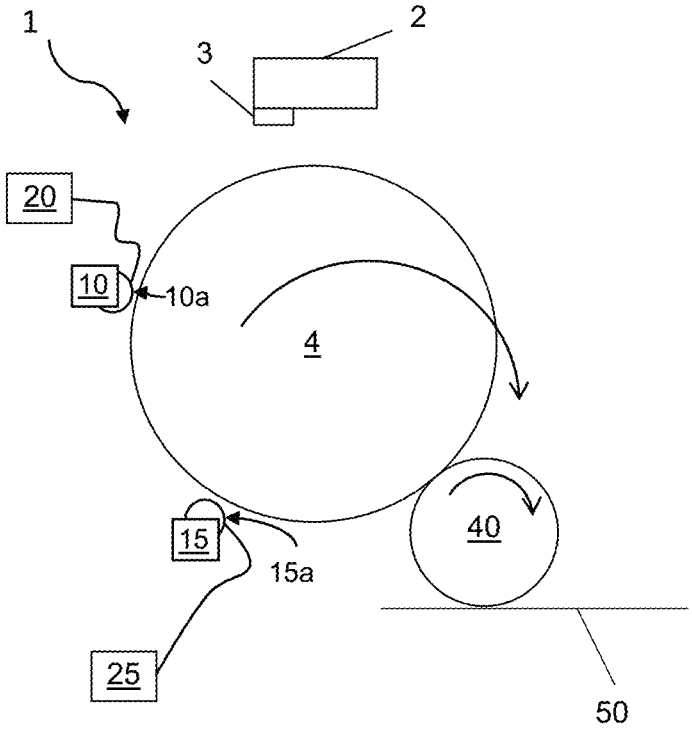
FIG. 1 is a schematic illustration of an example of an electrostatic printing apparatus.

Before the electrostatic printing apparatus, printing methods and related aspects are disclosed and described, it is to be understood that this disclosure is not limited to the particular process features and materials disclosed herein because such process features and materials may vary somewhat. It is also to be understood that the terminology used herein is used for the purpose of describing particular examples.

It is noted that, as used in this specification and the appended claims, the word "comprising" does not exclude the presence of elements other than those listed in a claim, "a" or "an" does not exclude a plurality, and a single processor or other unit may fulfil the functions of several units recited in the claims.

As used herein, the term "about" is used to provide flexibility to a numerical range endpoint by providing that a given value may be a little above or a little below the endpoint to allow for variation in test methods or apparatus.

As used herein, a "toner" may be an electrostatic printing fluid, such as ink.

As used herein, the term "charged toner" may be defined as being a toner to which an electrical potential has been applied.

As used herein, "liquid electrostatic ink" or "electrostatic ink" generally refers to an ink composition that is suitable for use in an electrostatic printing process, sometimes termed an electrophotographic printing process. It may comprise pigment particles, which may comprise a thermoplastic resin.

The liquid electrostatic inks described herein may comprise a colourant and a thermoplastic resin dispersed in a carrier liquid. In some examples, the thermoplastic resin may comprise an ethylene acrylic acid resin, an ethylene methacrylic acid resin or combinations thereof. In some examples, the colourant is a white colourant which may be selected from $TiO_2$, calcium carbonate, zinc oxide, and mixtures thereof. In some examples, the electrostatic ink also comprises a charge director and/or a charge adjuvant. In some examples, the liquid electrostatic inks described herein may be ElectroInk® and any other Liquid Electro Photographic (LEP) inks developed by Hewlett-Packard Company.

As used herein, "carrier liquid" refers to the fluid in which the resins, pigment particles, colourant, charge directors and other additives can be dispersed to form a liquid electrostatic ink or electrostatic ink. The carrier liquids may include a mixture of a variety of different agents, such as surfactants, co-solvents, viscosity modifiers, and/or other possible ingredients. The carrier liquid can include or be a hydrocarbon, silicone oil, vegetable oil, etc. The carrier liquid can include, but is not limited to, an insulating, non-polar, non-aqueous liquid that can be used as a medium for the first and second resin components. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. In some examples, the carrier liquid ma can include, but is not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION).

As used herein, "electrostatic printing" or "electrophotographic printing" generally refers to the process that provides an image that is transferred from a photo imaging substrate either directly, or indirectly via an intermediate transfer member, to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 1000 V/cm or more, or in some examples 1500 V/cm or more.

Unless otherwise stated, any feature described herein can be combined with any aspect or any other feature described herein.

In an aspect, there is provided an electrostatic printing apparatus. The electrostatic printing apparatus comprising:

- a first toner unit to accommodate a first toner reservoir containing a toner;
- a second toner unit to accommodate a second toner reservoir containing a toner;
- a photoconductive member having a surface on which can be formed a latent electrostatic image;
- a first developer voltage supply to supply a voltage V1 to the first toner unit; and a second developer voltage supply to supply a voltage V2 to the second toner unit;

wherein the magnitude of V2 is greater than or equal to the magnitude of V1, such that, in use, an electric field is created between the first toner unit and a latent electrostatic image formed on the surface of the photoconductive member such that a first volume of charged toner from the first toner reservoir is attracted to the latent electrostatic image on the surface, and an electric field is created between the second toner unit and the first volume of charged toner on the surface and between the second toner unit and the surface such that a second volume of charged toner from the second toner reservoir is attracted to the surface and to the first volume of charged toner on the surface, such that a toner image comprising the first volume of charged toner and the second volume of charged toner is formed on the surface of the photoconductive member.

In some examples, the magnitude of V2 being equal to the magnitude of V1 is used to mean the magnitude of V2 is within 5 volts of the magnitude of V1.

In some examples, the toner image formed on the surface of the photoconductive member is a developed toner image. In some examples, the developed toner image comprises the first and second volumes of charged toner and is a toner image of the latent electrostatic image formed on the surface of the photoconductive member.

In some examples, the apparatus is adapted to form a toner image comprising the first volume of charged toner and the second volume of charged toner on the surface, wherein the second volume of charged toner is disposed on the first volume of charged toner.

In some examples, the printing apparatus further comprises a first toner transfer control module comprising a first developer voltage supply controller to control the voltage V1 supplied to the first toner unit by the first developer voltage supply to control the amount of toner transferred from the first toner reservoir to the latent electrostatic image on the surface in the first volume of charged toner.

In some examples, the printing apparatus further comprises a second toner transfer control module comprising a second developer voltage supply controller to control the voltage V2 supplied to the second toner unit by the second developer voltage supply to control the amount of toner transferred from the second toner reservoir to surface in the second volume of charged toner.

In some examples, the printing apparatus is a liquid electrophotographic printing apparatus and the toner is a liquid electrostatic ink. In some examples, the toner is a white liquid electrostatic ink.

In some examples, the toner of the first volume of charged toner and the toner of the second volume of charged toner have the same colour. In some examples, the toners are white. A white toner may comprises a white colourant.

In some examples, the toner of the first volume of charged toner and the toner in the second volume of charged toner comprise the same colourant. In some examples, the toner of the first volume of charged toner and the toner of the second volume of charged toner comprise the same thermoplastic resins. In some examples, the toner of the first volume of charged toner and the toner in the second volume of charged toner comprise the same carrier liquid. In some examples, the toner in the first volume of charged toner and the toner in the second volume of charged toner comprise the same colourant, the same thermoplastic resins and/or the same carrier liquids. In some examples, the toner of the first volume of charged toner is the same as the toner in the second volume of charged toner.

In some examples, the first toner unit is a first Binary Ink Developer (BID) unit. In some examples the first BID unit comprises a first developer roller. In some examples toner contained in a reservoir accommodated by the first BID is transferred to the first developer roller. In some examples, the first developer voltage supply supplies a voltage V1 to the first developer roller of the first BID unit. In some examples, the voltage V1 supplied to the first developer roller is also supplied to the toner as the toner contacts the first developer roller.

In some examples, the voltage $V_{1ink}$ of the first volume of charged toner on the surface of the photoconductive member is the voltage of the first volume of charged toner immediately before transfer of the second volume of charged toner to the surface. In some examples, the voltage $V_{1ink}$ of the first volume of charged toner on the surface of the photoconductive member has a magnitude in the range of about 10 to 100 volts lower than the magnitude of voltage V1. In some examples, the voltage $V_{1ink}$ is less than 100 volts lower in magnitude than the voltage V1.

In some examples, the second toner unit is a second Binary Ink Developer (BID) unit. In some examples, the second BID unit comprises a second developer roller. In some examples, toner contained in a reservoir accommodated by the second BID is transferred to the second developer roller. In some examples, the second developer voltage supply supplies a voltage V2 to the second developer roller of the second BID unit. In some examples, the voltage V2 supplied to the second developer roller is also supplied to the toner as the toner contacts the second developer roller.

In some examples, the voltage V2 is greater in magnitude than the voltage V1. In some examples, the voltage V2 is at least about 5 volts greater in magnitude than the magnitude of voltage V1. In some examples, the magnitude of voltage V2 is at least about 10 volts greater than the magnitude of voltage V1, in some examples at least about 25 volts greater, in some examples at least about 50 volts greater, in some examples at least about 100 volts greater, and in some examples the magnitude of voltage V2 is at least about 150 volts greater than the magnitude of voltage V1.

In some examples, the printing apparatus comprises a photo-charging unit for supplying a voltage $V_{background}$ to the photoconductive member to provide a uniform static charge on the surface of the photoconductive member. In some examples, voltage $V_{background}$ has a magnitude of greater than about 800 volts. In some examples, voltage $V_{background}$ has a magnitude of at least 900 volts. In some examples, voltage $V_{background}$ has a magnitude of at least 1000 volts. In some examples, voltage $V_{background}$ has a magnitude of at least 1100 volts.

All voltages described herein, for examples, voltages V1, V2 and $V_{background}$, are defined and measured in relation to a reference voltage $V_{ref}$.

In some examples, the photo-charging unit comprises a laser imaging portion for dissipating static charges in selected portions of the image area on the photoconductive member. In some examples, the laser imaging portion dissipates static charges in selected portions of the image area on the photoconductive member to provide a latent electrostatic image on the surface of the photoconductive member, the image portions having a reference voltage $V_{ref}$. The reference voltage $V_{ref}$ may be measured relative to ground potential. In some examples, the reference voltage $V_{ref}$ is approximately equal to ground potential, i.e. has a magnitude of about 0 volts. In some examples, reference voltage $V_{ref}$ has a magnitude of less than 200 volts. In some examples, reference voltage $V_{ref}$ has a magnitude of less than 100 volts. In some examples, reference voltage $V_{ref}$ has a magnitude of less than 50 volts. In some examples, reference voltage $V_{ref}$ has a magnitude of less than 25 volts. In some examples, reference voltage $V_{ref}$ has a magnitude of less than 10 volts. In some examples, reference voltage $V_{ref}$ has a magnitude of less than 5 volts.

The voltages described herein may be positive or negative voltages. In some examples voltages V1, V2 and $V_{background}$ all have the same electrical polarity.

In some examples voltages V1, V2 and $V_{background}$ are all negative. In some examples voltages V1, V2, $V_{ref}$ and $V_{background}$ all have the same electrical polarity. In some examples voltages V1, V2, $V_{ref}$ and $V_{background}$ are all negative.

In some examples, voltage V1 has a magnitude of at least 100 volts. In some examples, voltage V1 has a magnitude of at least 200 volts. In some examples, voltage V1 has a magnitude of at least 300 volts.

In some examples, voltage V1 has a magnitude of less than 600 volts. In some examples voltage V1 has a magnitude of less than 450 volts.

In some examples, voltage V2 has a magnitude of at least 300 volts. In some examples, voltage V2 has a magnitude of at least 350 volts. In some examples, voltage V2 has a magnitude of at least 400 volts. In some examples, voltage V2 has a magnitude of at least 450 volts.

In some examples, voltage V2 has a magnitude lower than a value 100 volts less than the magnitude of $V_{background}$ (i.e. a magnitude lower than the $|V_{background}|-100$ volts). In some examples, voltage V2 has a magnitude lower than a value 200 volts less than the magnitude of $V_{background}$. In some examples, voltage V2 has a magnitude lower than a value 300 volts less than the magnitude of $V_{background}$ In some examples, voltage V2 has a magnitude of between 300 volts and 700 volts. In some examples, voltage V2 has a magnitude of between 350 volts and 600 volts.

In some examples, the photoconductive member is a photo-imaging cylinder. In some examples, the photo-imaging cylinder is rotatable.

In an aspect, there is provided a method of electrostatic printing. The method comprising:

forming a latent electrostatic image on a surface;

transferring to the latent electrostatic image on the surface a first volume of a charged toner;

transferring to the surface a second volume of a charged toner, such that a toner image comprising the first volume of charged toner and the second volume of charged toner is formed on the surface, the second volume of charged toner being disposed on the first volume of charged toner; and transferring the image to a print substrate.

In some examples, the first volume of charged toner and the second volume of charged toner are transferred to the same latent electrostatic image on the surface.

In some examples, the first volume of charged toner is transferred to the surface from a first toner reservoir housed in a first toner unit, and the process comprises controlling the amount of toner transferred to the surface in the first volume of charged toner by providing an electric field between the first toner unit and the latent electrostatic image on the surface such that the first volume of charged toner is attracted to the latent electrostatic image on the surface from the first toner reservoir housed in the first toner unit In some examples, the second volume of charged toner is transferred to the surface from a second toner reservoir housed in a second toner unit, and the process comprises controlling the amount of toner transferred to the surface in the second volume of charged toner by providing an electric field between the second toner unit and the first volume of charged toner on the surface and between the second toner unit and the surface, such that the second volume of charged toner is attracted to the first volume of charged toner on the surface and to the surface from the second toner reservoir housed in the second toner unit.

In some examples, the first volume of charged toner is transferred to the surface from a first toner unit, and the method comprises:

determining a desired amount of toner to be transferred from the first toner unit to the surface in the first volume of charged toner;

determining a first voltage V1 to be applied to the first toner unit to provide an electric field between the first toner unit and the surface such that the desired amount of toner is transferred from the first toner unit to the surface in the first volume of charged toner; and applying a voltage V1 to the first toner unit.

In some examples, determining a desired amount of toner to be transferred from the first toner unit to the surface in the first volume of charged toner may comprise determining a desired amount of toner in order to produce a toner image having a pre-determined parameter value. In some examples, the pre-determined parameter value is an optical density that is less than or at least a pre-determined value. In some examples, the pre-determined parameter value is at least a pre-determined opacity value.

In some examples, determining a desired amount of toner to be transferred from the first toner unit to the surface in the first volume of charged toner may comprise selecting a pre-determined value for the amount of toner to be transferred to the surface in the first volume of charged toner.

In some examples, determining a first voltage V1 to be applied to the first toner unit to provide an electric field between the first toner unit and the surface such that the desired amount of toner is transferred from the first toner unit to the surface in the first volume of charged toner may comprise determining via look up tables the voltage V1 to be used in order to transfer a pre-determined amount of toner to the surface, for example in order to transfer a pre-determined amount of toner to the surface to form a pre-determined thickness of toner on the surface.

In some examples, determining a first voltage V1 to be applied to the first toner unit to provide an electric field between the first toner unit and the surface such that the desired amount of toner is transferred from the first toner unit to the surface in the first volume of charged toner may comprise determining via look up tables the voltage V1 to be used in order to provide a toner image having a pre-determined parameter for a given voltage V2.

In some examples, determining a first voltage V1 to be applied to the first toner unit to provide an electric field between the first toner unit and the surface such that the desired amount of toner is transferred from the first toner unit to the surface in the first volume of charged toner may comprise selecting a voltage V1 and determining, for example for pre-determined value of voltage V2, whether the image printed on the print substrate meets a desired pre-determined parameter, for example a desired amount or thickness of charge toner, a desired opacity or a desired optical density. If the printed image is determined to satisfy the pre-determined parameter, no change is made to the voltage V1. If the printed image does not satisfy the pre-determined parameter, the voltage V1 may be adjusted, for example by a second developer voltage supply controller. If the voltage V1 is adjusted, it can be determined whether the printed image produced at the new value of voltage V1 meets the pre-determined parameter. The process can be continued in this way until the pre-determined parameter is satisfied.

In some examples, the voltage V2 is set, for example by the second toner transfer control module, to be a pre-determined voltage. In these examples, the voltage V1 may be adjusted to ensure the printed image satisfies a pre-determined parameter, for example to ensure the printed image has an opacity of at least a pre-determined value.

In some examples, the second volume of charged toner is transferred to the surface from a second toner unit, and the method comprises:

determining a desired amount of toner to be transferred from the second toner unit to the surface in the second volume of charged toner;

determining a second voltage V2 to be applied to the second toner unit to provide an electric field between the second toner unit and the surface and the toner unit and the first volume of charged toner on the surface such that the desired amount of toner is transferred from the second toner unit to the surface and the first volume of charged toner on the surface in the second volume of charged toner; and applying a voltage V2 to the second toner unit.

In some examples, determining a desired amount of toner to be transferred from the second toner unit to the surface in the second volume of charged toner may comprise determining a desired amount of toner in order to produce a toner image having a pre-determined parameter value. In some examples, the pre-determined parameter value is an optical density that is less than or at least a pre-determined values. In some examples, the pre-determined parameter value is at least a pre-determined opacity value.

In some examples, determining a desired amount of toner to be transferred from the second toner unit to the surface in the second volume of charged toner may comprise selecting a pre-determined value for the amount of toner to be transferred to the surface in the second volume of charged toner.

In some examples, determining a voltage V2 to be applied to the second toner unit to provide an electric field between the second toner unit and the surface and the second toner unit and the first volume of charged toner on the surface such that the desired amount of toner is transferred from the second toner unit to the surface in the second volume of charged toner may comprise determining via look up tables the voltage V2 to be used in order to transfer a pre-determined amount of toner to the surface, for example in order to transfer a pre-determined amount of toner to the surface to form a pre-determined thickness of toner on the surface.

In some examples, determining a voltage V2 to be applied to the second toner unit to provide an electric field between the second toner unit and the surface and the second toner unit and the first volume of charged toner on the surface such that the desired amount of toner is transferred from the second toner unit to the surface in the second volume of charged toner may comprise determining via look up tables the voltage V2 to be used in order to provide a toner image having a pre-determined parameter for a given voltage V1.

In some examples, determining a second voltage V2 to be applied to the second toner unit to provide an electric field between the second toner unit and the surface such that the desired amount of toner is transferred from the second toner unit to the surface in the second volume of charged toner may comprise selecting a voltage V2, for example for a pre-determined value of voltage V1, and determining whether the image printed on the print substrate meets a desired pre-determined parameter, for example a desired amount or thickness of toner, a desired opacity or a desired optical density. If the printed image is determined to satisfy the pre-determined parameter, no change is made to the voltage V2. If the printed image does not satisfy the pre-determined parameter, the voltage V2 may be adjusted, for example by a second developer voltage supply controller. If the voltage V2 is adjusted, it can be determined whether the printed image produced at the new value of voltage V2 meets the pre-determined parameter. The process can be continued in this way until the pre-determined parameter is satisfied.

In some examples, the voltage V1 is set, for example by the first toner transfer control module, to be a pre-determined voltage. In these examples, the voltage V2 may be adjusted to ensure the printed image satisfies a pre-determined parameter, for example to ensure the printed image as an opacity of at least a pre-determined value.

In some examples, the voltage V1 and the voltage V2 are adjusted to ensure the printed image satisfies a pre-determined parameter In some examples, determining a desired amount of toner to be transferred from either the first or second toner unit to the surface in the first or second volumes of charged toner respectively, may comprise determining a desired amount of toner in order to produce a toner image having a pre-determined optical density.

In some examples, determining a desired amount of toner to be transferred from either the first or second toner unit to the surface in the first or second volumes of charged toner respectively, may comprise determining a desired amount of toner in order to produce a toner image having a pre-determined opacity.

In some examples, the surface is the surface of a photoconductive member. In some examples, the photoconductive member is a photo-imaging cylinder. In some examples, the photo-imaging cylinder is rotatable. In some examples, the rotatable photo-imaging cylinder rotates relative to a photo-charging unit comprising a laser imaging portion and first and second toner units such that a latent electrostatic image is formed on a portion of the photo-imaging cylinder aligned with the laser imaging portion of the photo-charging unit, on rotation of the photo-imaging cylinder the portion of the photo-imaging cylinder on which the latent electrostatic image has been formed rotates towards the first toner unit. In examples in which the first toner unit is a first BID unit comprising a first developer roller, the first developer roller contacts the latent electrostatic image when the photo-imaging cylinder is rotated such that the latent electrostatic image is aligned with the first developer roller. A first volume of charged toner may be transferred from the first developer roller to the portion of the latent electrostatic image when a voltage V1 is applied to the first developer roller. As the photo-imaging cylinder continues to rotate the portion moves towards the second toner unit. In examples in which the second toner unit is a second BID unit comprising a second developer roller, the second developer roller contacts the portion of the photo-imaging cylinder to which toner has been transferred from the first developer roller when the photo-imaging cylinder is rotated such that the portion is aligned with the second developer roller. A second volume of charged toner may be transferred from the second developer roller to the portion of the photo-imaging cylinder when a voltage V2 is applied to the second developer roller. The portion of the photo-imaging cylinder on which a toner image comprising first and second volumes of charged toner may then be transferred to a print substrate. Following transfer of the toner image from the surface of the photo-imaging cylinder, the photo-imaging cylinder may continue to rotate so that a new latent electrostatic image can be formed on the portion of the photo-imaging cylinder when the portion of the photo-imaging cylinder completes a full rotation to be aligned with the photo-charging unit.

In some examples, a portion of the surface of the photo-imaging cylinder on which a latent electrostatic image is formed undergoes a partial rotation before a first volume of charged toner is transferred to the portion of the surface from a first toner unit, from the first toner unit the portion of the surface of the photo-imaging cylinder undergoes another partial rotation before a second volume of charged toner is transferred to the portion of the surface from a second toner unit.

In an aspect, a non-transitory computer readable storage medium encoded with instructions, executable by a processor, is provided. The non-transitory computer readable storage medium encoded with instructions comprising:

instructions to determine a first voltage V1 to be applied to a first toner unit, V1 being such that charged toner in an electric field between the first toner unit and a surface at a reference voltage will transfer to the surface;

instructions to determine a second voltage V2 to a be applied to a second toner unit, V2 being such that charged toner in an electric field between the second toner unit and a surface bearing charged toner will transfer to the surface bearing charged toner.

In some examples, the surface bearing charged toner is a surface to which charged toner is transferred from a first toner unit to which a first voltage V1 is applied.

In some examples, the instructions to determine the first voltage or the second voltage comprise instructions to determine an indication of the thickness of a layer of charged toner transferred to a surface and an indication of a desired thickness of the layer, and whether the determined voltage results in a desired thickness of the layer and, if not, to determine a modified voltage.

In some examples, non-transitory computer readable storage medium encoded with instructions further comprises instructions to control a voltage source to supply at least one of the first toner unit and the second toner unit with a determined voltage.

FIG. 1 shows a schematic illustration of an example of an electrostatic printing apparatus 1 which is a Liquid Electro Photographic (LEP) printing apparatus. An image, including any combination of graphics, text and images, may be communicated to the printing apparatus 1. According to an illustrative example, firstly, the photo charging unit 2 deposits a uniform static charge on the photoconductive surface which in this example is a photo-imaging cylinder 4. Next a laser imaging portion 3 of the photo charging unit 2 dissipates the static charges in selected portions of the image area on the photo-imaging cylinder 4 to leave a latent electrostatic image on a charged background. The latent electrostatic image is an electrostatic charge pattern representing the image to be printed. A charged toner, in this example the toner is an electrostatic ink, is then transferred to the photo-imaging cylinder 4 by toner units 10 and 15, in this example the toner units 10 and 15 are Binary Ink Developer (BID) units.

The uniform static charge on the photoconductive surface may be provided by supplying a voltage $V_{background}$ to the photoconductive surface from the photo charging unit 2. The magnitude of the voltage of the image areas of the photoconductive surface is reduced to a reference voltage $V_{ref}$ from voltage $V_{background}$ on dissipation of the static charge by the laser imaging portion 3 of the photo charging unit 2. In this illustrative example, the non-image areas of the surface (background areas) are maintained at a voltage of $V_{background}$. In some examples, the reference voltage $V_{ref}$ of the image areas of the photoconductive surface is approximately at ground potential.

The printing apparatus 1 shown in FIG. 1 comprises a first toner unit 10, in this example a BID unit 10, to accommodate a first toner reservoir containing a toner and a second toner unit 15, in this example a BID unit 15, to accommodate a second toner reservoir containing a toner. In examples, the toner contained in the first and second toner reservoirs is the same toner. In this example, as the printing apparatus 1 is a LEP printing apparatus, the toner is a liquid electrostatic ink. The first BID unit 10 comprises a first developer roller 10*a* for applying a charged toner from the first toner reservoir housed in the first BID unit 10 to the photo-imaging cylinder 4. The second BID unit 15 comprises a second developer roller 15*a* for applying a charged toner from the second reservoir housed in the second BID unit 15 to the photo-imaging cylinder 4. The first and second developer rollers 10*a* and 15*a* engage with the same latent electrostatic image formed on the surface of the photo-imaging cylinder 4.

The printing apparatus 1 shown in FIG. 1 also comprises a first developer voltage supply 20 to supply a voltage V1 to the first developer roller 10*a* of the first BID unit 10 and a second developer voltage supply 25 to supply a voltage V2 to the second developer roller 15*a* of the second BID unit 15. The first and second developer voltage supplies 20 and 25 may be programmed to supply a pre-determined voltage to the first and second developer rollers 10*a* and 15*a* of the first and second BID units 10 and 15 respectively.

In this illustrative example, in use, the first developer voltage supply supplies a voltage V1 to the first developer roller 10*a* of the first BID unit 10 such that an electric field is created between the first developer roller 10*a* of the first toner unit 10 and the latent electrostatic image on the surface of the photo-imaging cylinder 4 such that a first volume of charged toner is transferred to the latent electrostatic image from the first developer roller 10*a*. The first developer voltage supply 20 may be programmed to supply a voltage V1 which is greater in magnitude than voltage $V_{ref}$ and lower in magnitude than $V_{background}$ to the first developer roller 10*a*. Supplying a voltage V1 to the first developer roller 10*a* which is greater in magnitude than $V_{ref}$ provides an attractive electric field between the first developer roller 10*a* and the latent electrostatic image such that a first volume of a charged toner is transferred to the latent electrostatic image. Supplying a voltage V1 to the first developer roller 10*a* which is lower in magnitude than $V_{background}$ provides a repulsive electric field between the first developer roller 10*a* and the non-image areas (background areas) of the photoconductive surface such that charged toner from the first developer roller 10*a* is repelled from the non-image areas of the photoconductive surface.

The voltage V2 supplied to the second developer roller 15*a* of the second BID unit 15 has a greater magnitude than the voltage V1 supplied to the first developer roller 10*a* of the first BID unit 10. Ensuring that the magnitude of voltage V2 is greater than the voltage V1 allows for toner, e.g. an electrostatic ink, to be transferred from both the first BID unit 10 and the second BID unit 15 to a single latent electrostatic image formed on the photo-imaging cylinder 4 before transfer of the formed toner image from the photo-imaging cylinder 4 to a print substrate 50. In some examples, transfer of the toner image form the photo-imaging cylinder 4 to the print substrate may occur via an intermediate transfer member (ITM) 40.

According to an illustrative example, a latent electrostatic image is formed on rotating photo-imaging cylinder 4 which rotates such that the latent electrostatic image is moved towards the first BID unit 10. The first BID unit 10 prepares a thin film of a charged toner, in this example the toner is a liquid electrostatic ink, on the first developer roller 10*a* and the first developer roller 10*a* engages with the photo-imaging cylinder 4. The voltage V1 supplied to the first developer roller 10*a* of the first BID unit 10 by the first developer voltage supply 20 creates an electric field between the first developer roller 10*a* of the first BID unit 10 and the latent electrostatic image on the photo-imaging cylinder 4 such that a first volume of a liquid electrostatic ink is attracted to the latent electrostatic image from the first developer roller 10*a* of the first BID unit 10 and the liquid electrostatic ink is repelled from the non-image area (background) of the surface of the photo-imaging cylinder 4 as the photo-imaging cylinder 4 continues to rotate towards the second BID unit 15. The first volume of charged toner on the surface of the photo-imaging cylinder 4 has a voltage with a magnitude greater than the voltage of the latent electrostatic image. The voltage $V_{1ink}$ of the first volume of charged toner on the surface of the photo-imaging cylinder 4 may be slightly lower in magnitude than the voltage V1 applied to the first developer roller 10*a*. As the photo-imaging cylinder 4 rotates towards the second BID unit 15 the voltage $V_{1ink}$ of the first volume of charged toner on the surface of the latent electrostatic image may undergo relaxation.

The second developer voltage supply 25 may be programmed to supply a voltage V2, which is greater in magnitude than voltage V1 as well as being greater in magnitude than voltage $V_{ref}$ and lower in magnitude than $V_{background}$, to the second developer roller 15*a*. Supplying a voltage V2 to the second developer roller 15*a* which is greater in magnitude than voltage V1 and voltage $V_{ref}$ provides an attractive electric field between the second developer roller 15*a* and any areas of the latent electrostatic image that are not covered by a first volume of a charged toner as well as between the second developer roller 15*a* and the first volume of charged toner (in this example the first volume of charged toner on the surface has a voltage of $V_{1ink}$ which is lower in magnitude than voltage V1). Supplying a voltage V2 to the second developer roller 15*a* which is lower in magnitude than $V_{background}$ provides a repulsive electric field between the second developer roller 15*a* and the non-image areas (background areas) of the photoconductive surface such that charged toner from the second developer roller 15*a* is repelled from the non-image areas of the photoconductive surface.

The second BID unit 15 prepares a thin film of a liquid electrostatic ink on the second developer roller 15*a* and the second developer roller 15*a* engages with the photo-imaging cylinder 4. The voltage V2 supplied to the second developer roller 15*a* of the second BID unit 15 by the second developer voltage supply 25 creates an electric field between the second developer roller 15*a* of the second BID unit 15 and the first volume of charged toner on the surface, in this example the first volume of charged liquid electrostatic ink, on the latent electrostatic image and between the second developer roller 15*a* of the second BID unit 15 and the latent electrostatic image such that a second volume of charged toner, in this example a second volume of charged liquid electrostatic ink, is attracted to the first volume of charged toner on the latent electrostatic image as well as to any areas of the latent electrostatic image that have not been covered by the first volume of charged toner from the second developer roller 15*a*. The resulting toner image formed on the photo-imaging cylinder 4 comprises the first volume of charged toner and the second volume of charged toner, in this example the first volume of charged liquid electrostatic ink and the second volume of charged liquid electrostatic ink. This toner image can then be transferred to a print substrate, for example a transparent print substrate.

Figure 2:
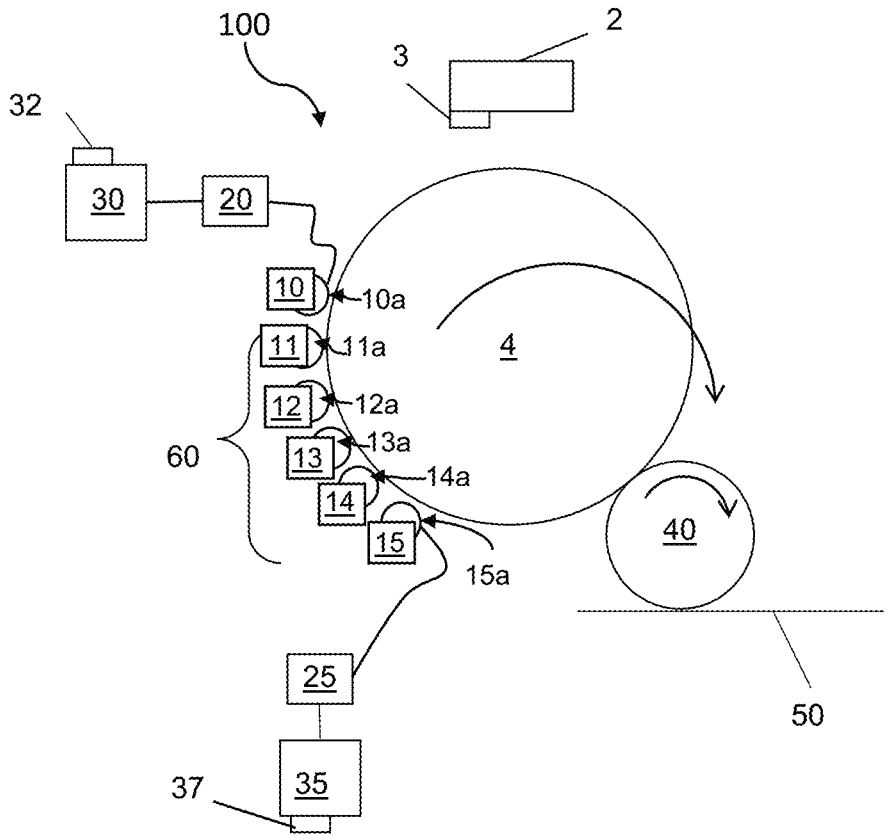
FIG. 2 is a schematic illustration of an example of an electrostatic printing apparatus.

FIG. 2 shows a schematic illustration of an example of an electrostatic printing apparatus 100 which is a Liquid Electro Photographic (LEP) printing apparatus. Reference numerals used in FIG. 2 which correspond to the reference numerals used in FIG. 1 designate the features described above in relation to FIG. 1. The printing apparatus 100 shown in FIG. 2 comprises a first toner transfer control module 30 for controlling the amount of charged toner transferred from the first developer roller 10*a* of the first BID unit 10 to the latent electrostatic image on the surface of the photo-imaging cylinder 4. The first toner transfer control module 30 comprises a first developer voltage supply controller 32 to control the voltage V1 supplied to the first developer roller 10*a* of the BID unit 10 by the first developer voltage supply 20. In some examples, the voltage V1 may be adjusted to increase or decrease the electric field between the first developer roller 10*a* of the first BID unit 10 and the latent electrostatic image on the photo-imaging cylinder 4. The amount of toner transferred to the latent electrostatic image by the first BID unit 10 depends on the strength and direction of this electric field.

In some examples, the first toner transfer control module 30 may be programmed to determine a voltage V1 to be applied to the first developer roller 10*a* in order to transfer a pre-determined amount of toner to the latent electrostatic image in the first volume of charged toner.

The printing apparatus 100 shown in FIG. 2 also comprises a second toner transfer control module 35 for controlling the amount of toner transferred from the second developer roller 15*a* of the second BID unit 15 to the latent electrostatic image and the first volume of charged toner on the photo-imaging cylinder 4. The second toner transfer control module 35 comprises a second developer voltage supply controller 37 to control the voltage V2 supplied to the second developer roller 15*a* of the second BID unit 15 by the second developer voltage supply 25. The voltage V2 can be adjusted to increase or decrease the electric field between the second developer roller 15*a* of the second BID unit 15 and the latent electrostatic image on the surface of the photo-imaging cylinder 4 and the electric field between the second developer roller 15*a* of the second BID unit 15 and the first volume of charged toner on the surface of the photo-imaging cylinder 4. The amount of toner transferred to the latent electrostatic image on which the first volume of charged toner is disposed by the second BID unit 15 depends on the strength and direction of this electric field.

In some examples, the second toner transfer control module 35 may be programmed to determine a voltage V2 to be applied to the second developer roller 15*a* in order to transfer a pre-determined amount of toner to the surface in the second volume of charged toner.

In some examples, the second toner transfer control module 35 may be programmed to determine a voltage V2 to be applied to the second developer roller 15*a* in order to transfer an amount of toner to the surface in the second volume of charged toner such that the total amount of toner transferred to the surface in the first and second volumes of charged toner is greater than a pre-determined total amount of toner.

The first and second volumes of charged toner, e.g. liquid electrostatic ink, transferred to the surface of the photo-imaging cylinder 4 may have the same colour. For example, the first and second volumes of charged toner may both comprise a white toner, for example a white liquid electrostatic ink.

According to an illustrative example, the printing apparatuses shown in FIGS. 1 and 2 may be used to increase the opacity of an image printed on a print substrate without double printing an image onto a print substrate. For example, the printing apparatuses shown in FIGS. 1 and 2 may be used to transfer a first volume of a charged white liquid electrostatic ink and a second volume of a charged white liquid electrostatic ink to the same electrostatic image formed on a photo-imaging cylinder 4. The toner image comprising the first and second volumes of charged white electrostatic ink can then be transferred to a print substrate, for example a transparent print substrate.

According to an illustrative example, the printing apparatus 100 shown in FIG. 2 comprises additional toner units 60, in this example additional BID units 60. In this example, the additional BID units 60 comprise four BID units 11, 12, 13, 14, each BID unit 11, 12, 13, 14 comprising a developer roller 11*a*, 12*a*, 13*a*, 14*a* respectively wherein each developer roller 11*a*, 12*a*, 13*a*, 14*a* engages with a different latent electrostatic image. For example, additional BID units 60 may be used to transfer different coloured toners (e.g. CMYK toners) to different latent electrostatic images to form a single coloured toner image on a particular latent electrostatic image, where each single coloured toner image is transferred to the intermediate transfer member (ITM) 40 from the photo-imaging cylinder 4 before a new latent electrostatic image is formed on the surface photo-imaging cylinder 4 on to which a new coloured toner may be transferred.

In examples, the printing apparatus shown in FIG. 2 may be used to form an image on a print substrate, e.g. a transparent print substrate, the image comprising a white toner image comprising a first and second volume of a white toner, the white toner image disposed on the print substrate and different coloured toner images disposed on the white toner image.

In other examples, one of the additional toner units 11, 12, 13, 14 may accommodate a toner reservoir containing a white toner and the first and second toner units 10 and 15 may accommodate toner reservoirs containing different coloured toners.

Figure 3:
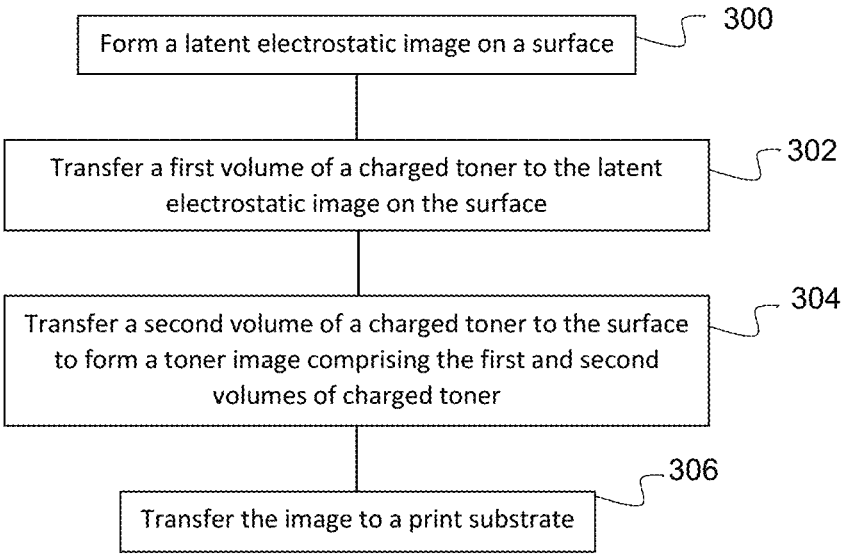
FIG. 3 is a flow diagram of an example of a method of electrostatic printing.

FIG. 3 is a flow diagram of an example of a method of electrostatic printing. In block 300 a latent electrostatic image is formed on a surface, for example a surface of a photo-imaging cylinder. According to an illustrative example, a latent electrostatic image may be formed on a surface by depositing a uniform static charge on the surface, for example by applying a voltage $V_{background}$ to the surface and then dissipating the static charges in selected portions of the image area on the surface to leave a latent electrostatic image on a charged background, the charged background having a voltage $V_{background}$. The image area of the formed latent electrostatic image may be reduced to a reference voltage $V_{ref}$. Voltage $V_{ref}$ may be equal to ground potential.

A first volume of a charged toner, e.g. a charged liquid electrostatic ink, is then transferred to the latent electrostatic image on the surface (block 302). A second volume of a charged toner, e.g. a charged liquid electrostatic ink, is then transferred to the surface, for example to the same latent electrostatic image on the surface, such that a toner image comprising the first volume of charged toner and the second volume of charged toner is formed on the surface, wherein the second volume of charged toner is disposed on the first volume of charged toner (block 304). The toner image comprising the first and second volumes of charged toner is then transferred to a print substrate (block 306), for example a transparent print substrate.

In some examples, the first and second volumes of charged toner contain toners having the same colour. In some examples the toners are white. In some examples the first and second volumes of charged toner contain the same toner.

In some examples, the toner is a liquid electrostatic ink. In some examples the toner is a white liquid electrostatic ink.

Figure 4:
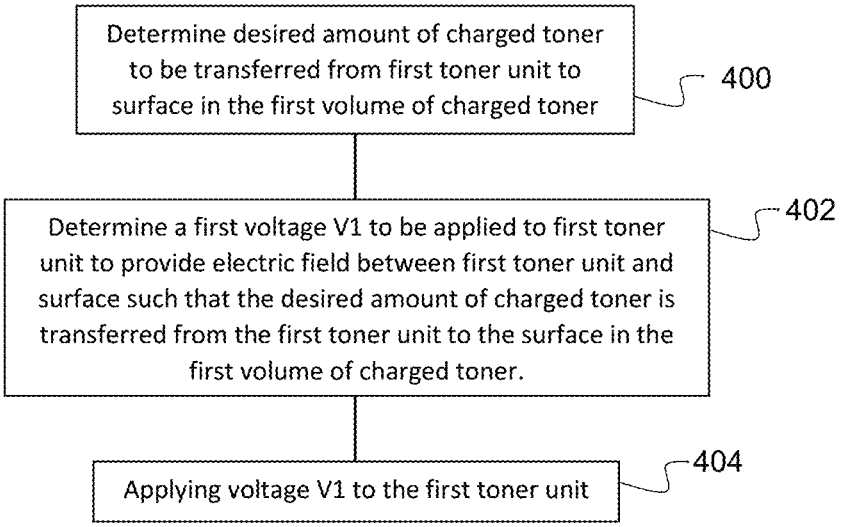
FIG. 4 is a flow diagram of an example of a method of transferring a volume of a charged toner to a surface.

FIG. 4 shows an example of the process of block 302 in greater detail. In block 400, a desired amount of toner to be transferred from the first toner unit to the surface in the first volume of charged toner is determined. Then a first voltage V1 to be applied to the first toner unit in order to provide an electric field between the first toner unit and the surface such that the desired amount of toner is transferred from the first toner unit to the surface in the first volume of toner is determined (block 402). An electric field may be provided between the first toner unit and the surface such that toner is transferred from the first toner unit to the surface by determining the voltage V1 such that the voltage V1 has a greater magnitude than the reference voltage $V_{ref}$ of the image area of the latent electrostatic image and a lower magnitude than the voltage $V_{background}$ of the background area of the surface. Determining that voltage V1 such that voltage V1 has a greater magnitude than the voltage $V_{ref}$ and a lower magnitude than the voltage $V_{background}$ ensures that first volume of charged toner is transferred from the first toner unit to the image area of the latent electrostatic image of the surface and repelled from the background areas of the surface. The determined voltage V1 is then applied to the first toner unit (block 404).

Figure 5:
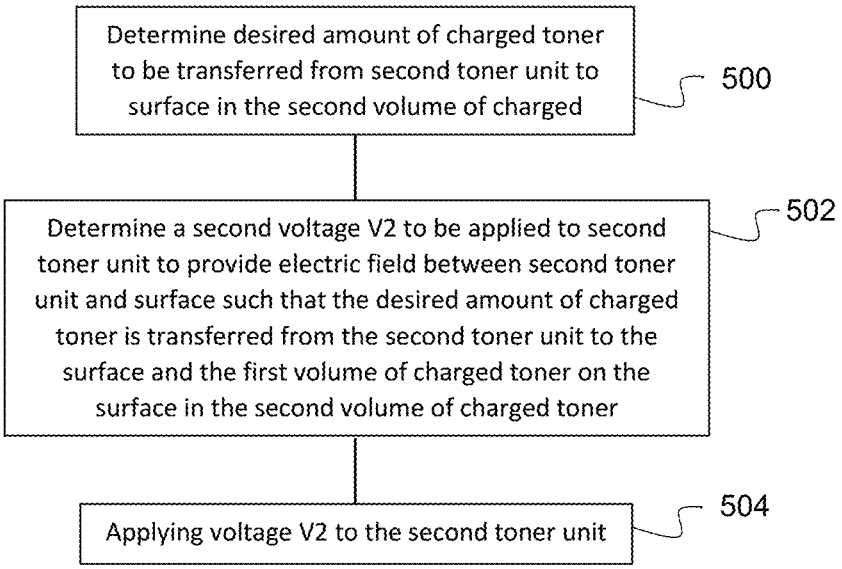
FIG. 5 is a flow diagram of an example of a method of transferring a volume of a charged toner to a surface.

FIG. 5 shows an example of the processes of block 304 in greater detail. In block 500 a desired amount of toner to be transferred from the second toner unit to the surface in the second volume of charged toner is determined. Then a second voltage V2 to be applied to the second toner unit in order to provide an electric field between the second toner unit and the surface as well as the second toner unit and the first volume of charged toner on the surface (block 502). In some examples, the voltage $V_{1ink}$ of the first volume of charged toner on the surface is the voltage of the first volume of charged toner on the surface immediately before transfer of the second volume of charged toner to the surface. In some examples $V_{1ink}$ is lower in magnitude than voltage V1. For example, the voltage $V_{1ink}$ may be 10 volts or more lower in magnitude than the voltage V1. In some examples, the voltage $V_{1ink}$ is 50 volts or more lower in magnitude than the voltage V2. An electric field may be provided between the second toner unit and the first volume of charged toner on the surface such that a second volume of charged toner is transferred from the second toner unit to the first volume of charged toner on the surface by ensuring that voltage V2 has a greater magnitude than $V_{1ink}$. In examples, $V_{1ink}$ may be greater in magnitude than voltage $V_{ref}$ of any image areas of the latent electrostatic image that are not covered by the first volume of charged toner image areas, in these examples and when voltage V2 has a greater magnitude than $V_{1ink}$ toner of the second volume of charged toner will be attracted to image areas of the surface of the latent electrostatic image that are not covered by the first volume of charged toner as well as the first volume of charged toner on the surface. The determined voltage V2 is then applied to the second toner unit (block 504).

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. In some examples, some blocks of the flow diagrams may not be necessary and/or additional blocks may be added. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of apparatus and modules described may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate set etc. The methods and modules may all be performed by a single processor or divided amongst several processors.

Such machine readable instructions may also be stored in a computer readable storage that can guide the computer or other programmable data processing devices to operate in a specific mode.

For example, the instructions may be provided on a non-transitory computer readable storage medium encoded with instructions, executable by a processor.

Figure 6:
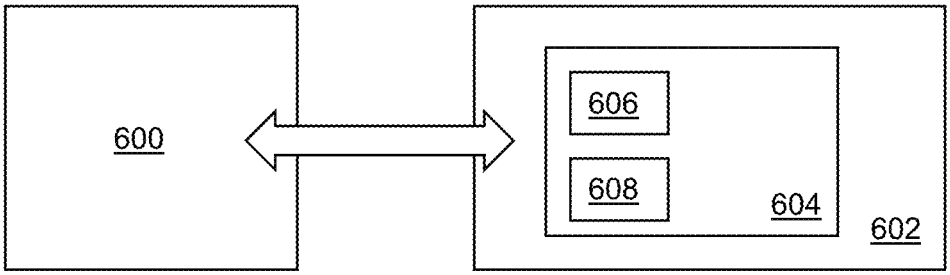
FIG. 6 is a simplified schematic of an example of a processor and a memory.

FIG. 6 shows an example of a processor 600 associated with a memory 602. The memory 602 comprises computer readable instructions 604 which are executable by the processor 600. The instructions 604 comprise:

Instructions 606 to determine a first voltage V1 to be applied to a first toner unit, V1 being such that charged toner in an electric field between the first toner unit and a surface at a reference voltage will transfer to the surface; and Instruction 608 to determine a second voltage V2 to a be applied to a second toner unit, V2 being such that charged toner in an electric field between the second toner unit and a surface bearing charged toner will transfer to the surface bearing charged toner.

Figure 7:
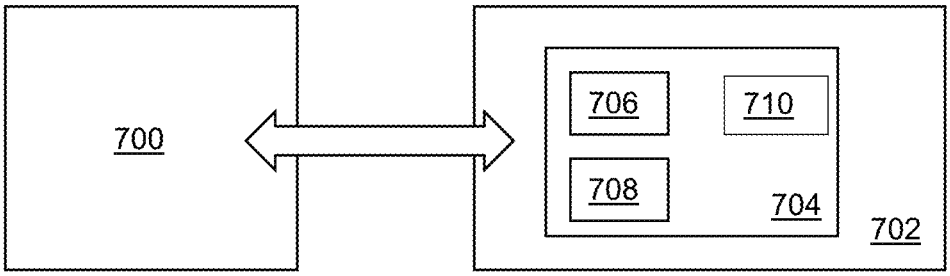
FIG. 7 is a simplified schematic of another example of a processor and a memory.

FIG. 7 shows an example of a processor 700 associated with a memory 702. The memory 702 comprises computer readable instructions 704 which are executable by the processor 700. The instructions 704 comprise:

Instructions 706 to determine a first voltage V1 to be applied to a first toner unit, V1 being such that charged toner in an electric field between the first toner unit and a surface at a reference voltage will transfer to the surface;

Instruction 708 to determine a second voltage V2 to a be applied to a second toner unit, V2 being such that charged toner in an electric field between the second toner unit and a surface bearing charged toner will transfer to the surface bearing charged toner; and Instruction 710 to control a voltage source to supply at least one of the first toner unit and the second toner unit with a determined voltage.

In examples, the instructions to determine the first voltage or the second voltage may comprise instructions to from an indication of the thickness of a layer of charged toner transferred to a surface and an indication of a desired thickness of the layer, if the determined voltage results in a desired thickness of the layer and, if not, to determine a modified voltage.

Such machine readable instructions may also be loaded onto a computer or other programmable data processing devices, so that the computer or other programmable data processing devices perform a series of operations to produce computer-implemented processing, thus the instructions executed on the computer or other programmable devices provide a operation for realizing functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

EXAMPLES

The following illustrates examples of the methods and other aspects described herein. Thus, these Examples should not be considered as limitations of the present disclosure, but are merely in place to teach how to make examples of the present disclosure.

Example 1

The apparatus described herein was used to print white liquid electrostatic ink using the method described herein.

Using a LEP printing apparatus, such as the printing apparatus illustrated in FIG. 1 and described above, a latent electrostatic image was formed on a surface of a photo-imaging cylinder by first applying using the photo charging unit to apply a static charge to the photo-imaging cylinder by applying a voltage $V_{background}$ to the photo-imaging cylinder and then using the laser imaging portion of the photo charging unit to dissipate the static charges in selected areas to form image areas having a voltage $V_{ref}$, wherein voltage $V_{ref}$ was approximately ground potential and therefore lower in magnitude than voltage $V_{background}$. In this example, the voltage $V_{background}$ was 1100V.

Figure 8:
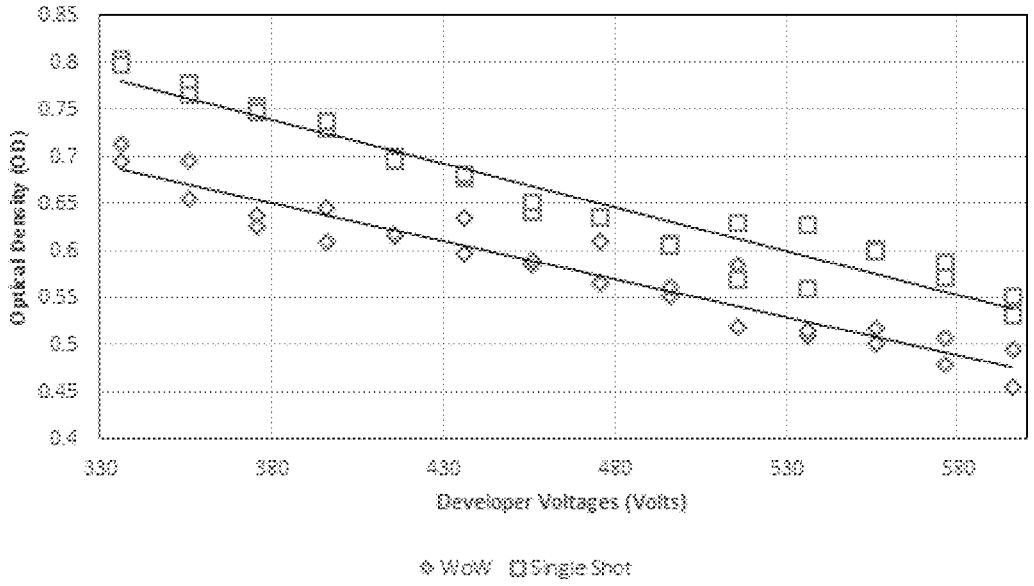
FIG. 8 is a graph showing the optical density of examples of images obtained at different developer voltages.

The LEP printing apparatus comprised a first BID unit 10 and a second BID unit 15 having first and second toner reservoirs, both reservoirs containing a white liquid electrostatic ink (HP Indigo's ElectroInk® white). The white liquid electrostatic ink was applied to the first and second developer rollers 10*a* and 15*a* of the first and second BID units 10 and 15 respectively. The first and second developer rollers 10*a* and 15*a* were contacted with the same latent electrostatic image formed on the surface. A voltage V1 was applied to the first developer roller 10*a* to provide an electric field to transfer a first volume of charged white liquid electrostatic ink from the first developer roller 10*a* to the latent electrostatic image formed on the surface. A voltage V2 was applied to the second developer roller 15*a* to provide an electric field to transfer a second volume of charged white electrostatic ink to the surface. The toner image formed on the surface comprising the first and second volumes of charged white electrostatic ink was transferred to a transparent print substrate via an ITM 40. The process was repeated to produce white images on print substrates for different second developer voltages V2 values. The first developer voltage V1 applied to the first developer roller 10*a* was set to 330 volts for each print. The second developer voltage V2 was increased from 330 volts to 600 volts as shown by the "WoW" data points in FIG. 8. The optical density and opacity of each of the white images formed was determined. The optical density was determined using an X-rite handheld spectrophotometer. The "WoW" data points in FIG. 8 show the optical density for each of the white images formed in this example under different developer voltages. As the second developer voltage V2 was increased, more toner was transferred to the surface in the second volume of charged toner which resulted in a decreased optical density of the white images. As can be seen from FIG. 9 a decreased optical density of the white images corresponds to an increase in opacity of the white images.

The "WoW" data points in FIG. 8 show that the optical density of an image can be controlled by controlling the developer voltages V1 and V2. The optical density is reduced as voltage V2 is increased and therefore the difference between voltage V1 and V2 is increased as a greater amount of toner in the second volume of charged toner is transferred to the surface.

Figure 9:
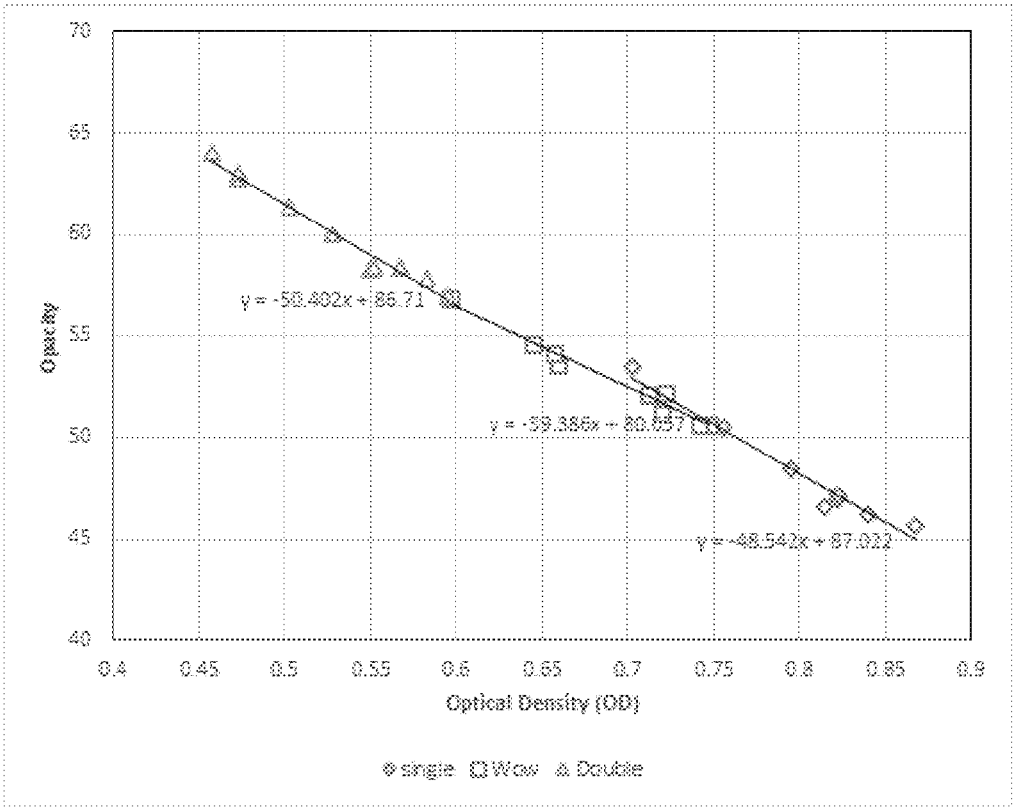
FIG. 9 is a graph showing the relationship between optical density and opacity of examples of images.

The "WoW" data points in FIG. 9 show that the optical density of the white images formed in this example is inversely proportional to the opacity of the white images. Therefore, the opacity of an image can also be controlled by controlling the developer voltages V1 and V2.

Comparative Example 1

Using a LEP printing apparatus of the prior art a latent electrostatic image was formed on a surface of a photo-imaging cylinder by first applying using the photo charging unit to apply a static charge to the photo-imaging cylinder by applying a voltage $V_{background}$ to the photo-imaging cylinder and then using the laser imaging portion of the photo charging unit to dissipate the static charges in selected areas to form image areas having a voltage $V_{ref}$, wherein voltage $V_{ref}$ was approximately ground potential and therefore lower in magnitude than voltage $V_{background}$. In this example, the voltage $V_{background}$ was 1100V.

The LEP printing apparatus comprised a BID unit having a toner reservoir containing a white liquid electrostatic ink (HP Indigo's ElectroInk® white). The white liquid electrostatic ink was applied to the developer roller of the BID unit. The developer roller was contacted with the latent electrostatic image formed on the surface. A developer voltage was applied to the developer roller to provide an electric field to transfer a volume of charged white liquid electrostatic ink from the developer roller to the latent electrostatic image formed on the surface. The toner image formed on the surface was transferred to a transparent print substrate via an ITM. The process was repeated to produce white images on print substrates for different values of developer voltage, the optical density and opacity of each of the white images formed was determined. The optical density was determined using an X-rite handheld spectrophotometer. The "single shot" data points in FIG. 8 show the optical density for each of the white images formed in this example under different developer voltages in the range of 330V to 600V.

The "single shot" data points in FIGS. 8 and 9 also show that the optical density and opacity of an image can be controlled by controlling the developer voltage. However, FIGS. 8 and 9 also show that the apparatus, methods and related aspects described herein can be used to provide images, for example white images, having an increased opacity compared to images formed using apparatus and methods of the prior art.

Previously, improvement in opacity of a "single shot" image as formed in comparative example 1 has been improved by double printing the image, i.e. repeating the process described in comparative example 1 to produce two layers of a toner image on the print substrate.

The present inventors have also found that using the described apparatus, methods and related aspects allows for improved efficiency in the printing of an image having improved opacity, for example compared to double printing of an image using apparatus and methods of the prior art.

While the method, apparatus and related aspects have been described with reference to certain examples, various modifications, changes, omissions, and substitutions can be made without departing from the spirit of the present disclosure. In particular, a feature or block from one example may be combined with or substituted by a feature/block of another example.

The features of any dependent claim may be combined with the features of any of the independent claims or other dependent claims.

The invention claimed is:

1. A printing device comprising:

a photoconductive member having a surface to receive a latent electrostatic image;

a photocharging unit to form the latent electrostatic image on the surface of the photoconductive member;

a first toner unit to transfer a first volume of a charged toner to the latent electrostatic image on the surface using a first voltage;

a second toner unit to transfer a second volume of a charged toner to the latent electrostatic image on the surface using a second voltage that is different from the first voltage;

wherein the first toner unit and the second toner unit transfer toner to the same latent electrostatic image, the second volume of charged toner being disposed on the first volume of charged toner;

wherein the first or the second voltage is determined based on a desired opacity of a layer of toner to be deposited.

2. The printing device of claim 1, further comprising an intermediate transfer member to transfer an image comprising the first and second volumes of toner from the photoconductive member to a print medium.

3. The printing device of claim 1, wherein each toner unit comprises a separate voltage supply to provide the first and second voltages, respectively.

4. The printing device of claim 1, wherein each toner unit comprises a developer roller.

5. The printing device of claim 1, wherein each toner unit comprises a reservoir of toner.

6. The printing device of claim 1, wherein the first and second toner units transfer toner having a same composition to the latent image.

7. The printing device of claim 6, wherein the first and second toner units both transfer white toner to the latent image.

8. The printing device of claim 1, wherein the first and second voltages are both greater in magnitude than a voltage Vref at portions of the photoconductive member comprising the latent electrostatic image.

9. The printing device of claim 1, wherein the first and second voltages are both lower in magnitude than a voltage Vbackground at portions of the photoconductive member outside of the latent electrostatic image.

10. A printing device comprising:

a photoconductive member having a surface to receive a latent electrostatic image;

a photocharging unit to form the latent electrostatic image on the surface of the photoconductive member;

a first toner unit to transfer a first volume of a charged toner to the latent electrostatic, image on the surface using a first voltage, a second toner unit to transfer a second volume of a charged toner to the latent electrostatic image on the surface using a second voltage that is different from the first voltage;

wherein the first toner unit and the second toner unit transfer toner of a same color.

11. The printing device of claim 10, wherein the second toner unit to dispose the second volume of toner on the first volume of toner.

12. The printing device of claim 10, further comprising an intermediate transfer member to transfer an image comprising the first and second volumes of toner from the photoconductive member to a print medium.

13. The printing device of claim 10, wherein each toner unit comprises a developer roller.

14. The printing device of claim 10, wherein each toner unit comprises a reservoir of toner.

15. The printing device of claim 10, wherein the first and second toner units both transfer white toner to the latent image.

16. The printing device of claim 10, wherein the first and second voltages are both greater in magnitude than a voltage Vref at portions of the photoconductive member comprising the latent electrostatic image.

17. The printing device of claim 10, wherein the first and second voltages are both lower in magnitude than a voltage Vbackground at portions of the photoconductive member outside of the latent electrostatic image.

18. The printing device of claim 10, wherein the first voltage is determined based on a desired opacity of a layer of toner to be deposited.

19. The printing device of claim 10, wherein the second voltage is determined based on a desired opacity of a layer of toner to be deposited.

20. The printing device of claim 10, wherein the first and second toner units transfer toner having a same composition to the latent image.

* * * * *